US005246150A

United States Patent [19]

Delia

[11] Patent Number: 5,246,150

[45] Date of Patent: Sep. 21, 1993

[54] PIVOTING DISPENSING CLOSURE

[75] Inventor: Anthony Delia, West Redding, Conn.

[73] Assignee: Calmar Inc., City of Industry, Calif.

[21] Appl. No.: 993,462

[22] Filed: Dec. 15, 1992

Related U.S. Application Data

[63] Continuation of Ser. No. 723,293, Jun. 28, 1991, abandoned.

[51] Int. Cl.[5] ..... B65D 47/00

[52] U.S. Cl. ..... 222/498; 222/558

[58] Field of Search ..... 222/556, 558, 448, 449, 222/526, 533, 534, 545, 536

[56] References Cited

U.S. PATENT DOCUMENTS

| | | | |
|---|---|---|---|
| 1,417,975 | 5/1922 | Crane | 222/558 |
| 1,484,589 | 2/1924 | Trubek | 222/556 |
| 1,791,004 | 2/1931 | Shepard . | |
| 1,852,198 | 4/1932 | Bemis . | |
| 1,934,699 | 11/1933 | Christen | 222/558 X |
| 1,977,302 | 10/1934 | Brill . | |
| 2,312,380 | 3/1943 | Bernhardt | 222/556 X |
| 2,439,985 | 4/1948 | Perelson . | |
| 2,444,995 | 7/1948 | Laing . | |
| 2,755,975 | 7/1956 | Sundberg . | |
| 3,036,747 | 5/1962 | Girard . | |
| 3,369,720 | 2/1968 | Libit et al. | 222/558 X |
| 3,896,978 | 7/1975 | Sahar | 222/556 X |
| 4,087,028 | 5/1978 | Lang . | |
| 4,278,179 | 7/1981 | McWilliams | 222/558 X |
| 4,458,818 | 7/1984 | Hansen . | |
| 4,776,501 | 10/1988 | Ostrowsky | 222/556 X |
| 4,804,098 | 2/1989 | Montgomery | 222/558 X |
| 4,936,493 | 6/1990 | Foster et al. | 222/556 X |
| 4,962,869 | 10/1990 | Gross et al. | 222/556 X |

FOREIGN PATENT DOCUMENTS

| | | | |
|---|---|---|---|
| 1016446 | 11/1952 | Fed. Rep. of Germany . | |
| 912795 | 4/1954 | Fed. Rep. of Germany . | |
| 2409760 | 9/1975 | Fed. Rep. of Germany | 222/558 |
| 2901239 | 1/1980 | Fed. Rep. of Germany | 222/558 |
| 1088161 | 3/1955 | France . | |
| 486062 | 10/1953 | Italy . | |
| 58672 | 3/1989 | Japan | 222/556 |
| 105399 | 1/1959 | Netherlands | 222/558 |

*Primary Examiner*—Andres Kashnikow
*Assistant Examiner*—Kenneth DeRosa
*Attorney, Agent, or Firm*—Watson, Cole, Grindle & Watson

[57] ABSTRACT

A dispensing closure for a squeeze container comprises a closure cap having a discharge spout terminating in a discharge orifice, and a spout cover hingedly connected to the cap for manual rocking movement about a transverse hinge axis between discharge orifice closed and open positions. The cover has a lid overlying and sealing the orifice closed and is snap locked thereto in the closed position.

4 Claims, 1 Drawing Sheet

10
11
12
13
14
15
16
17
18
19
21
22
23
24
25
26
27
28
29
31
32
33
34
3
6

PIVOTING DISPENSING CLOSURE

This application is a continuation of application Ser. No. 07/723,293, filed Jun. 28, 1991, now abandoned.

BACKGROUND OF THE INVENTION

This invention relates a dispensing closure for a squeeze container having at least one deformable wall portion. More particularly, the closure comprises a cap having a discharge spout containing a discharge orifice, and a spout cover hingedly connected to the cap for manual rocking movement about a transverse hinge axis between discharge orifice closed and open positions. When closed, the spout cover seals the discharge orifice and is snap locked in place.

Many squeezed dispensers for especially pasty products and viscous products have a discharge spout which is closed by a variety of closures. For example, threaded or snap end caps have been devised, or an external push-pull plug is provided for the spout opening. Otherwise, the spout itself is axially shifted relative to an internal plug by the provision of a threaded or a push-pull spout.

All such prior art disclosures are, however, not without their drawbacks. For example, a separate closure cap is easily misplaced or otherwise becomes clogged with product rendering it usuable. The internal and external plug arrangements are undesirable when product wets the plug or the spout which must be touched by the operator giving rise to an unsanitary condition. Besides, such prior art dispensing closures do not effectively seal the spout orifice during periods of non-use such as storage and shipping.

SUMMARY OF THE INVENTION

It is therefore an object of the present invention to provide a dispensing closure which avoids the drawbacks of the prior art and which is highly effective, easy to operate, sanitary and easy to assemble, economical, yet highly efficient.

Another object is to provide such a dispensing closure in which a spout cover is hingedly connected to a cap having a discharge spout, the cover being capable of manual rocking movement about a transverse hinge axis between discharge orifice closed and open positions. The cover has a transverse base supporting a lid for closing the discharge orifice, and the base at one side of the hinge axis is manually depressable for rocking the cover into its discharge open position. And, the lid is sealed over and snap locked to the spout orifice.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4, 5, 6:
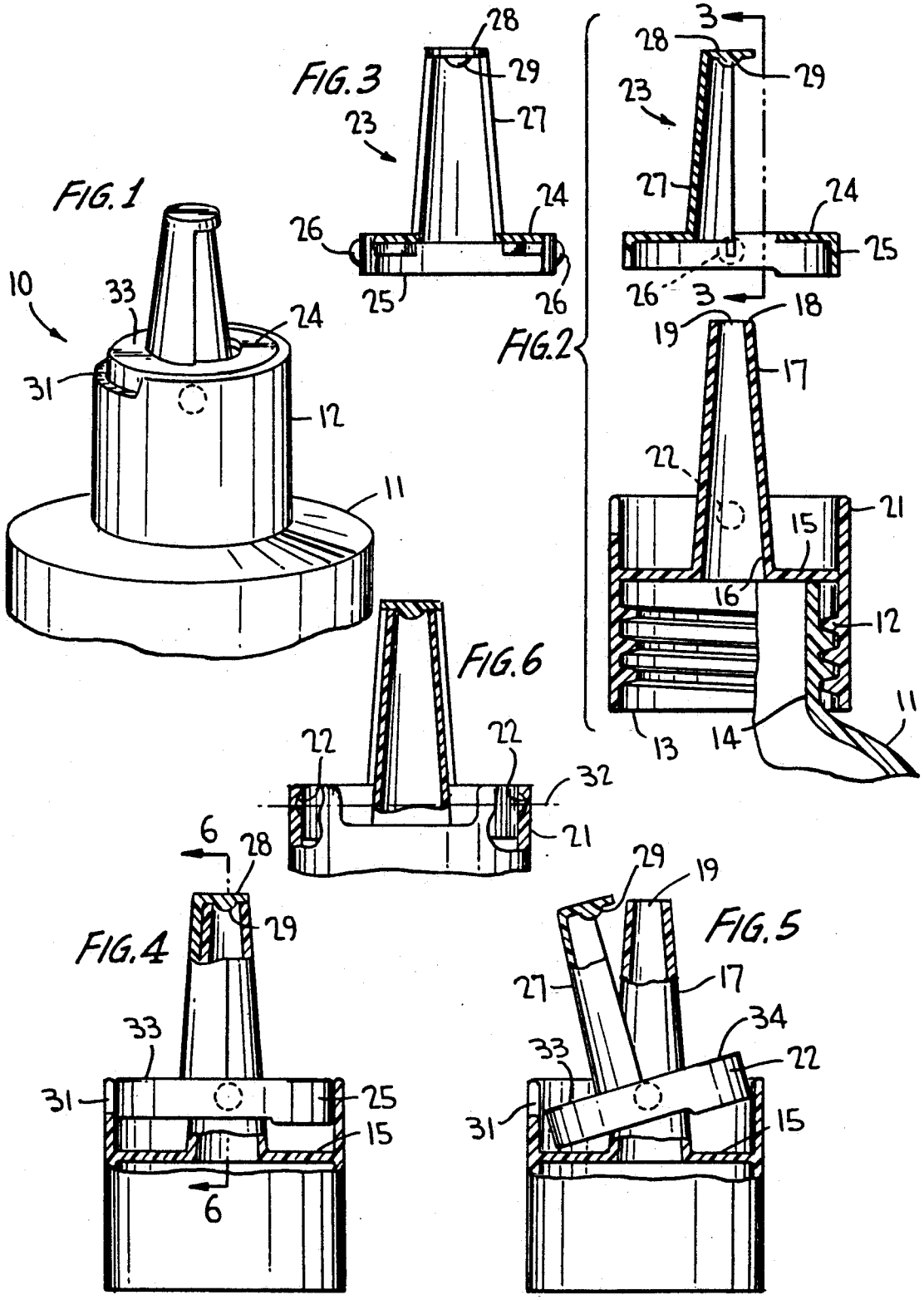
FIG. 1 is a perspective view of the dispensing closure according to the invention shown mounted on a squeeze container.
FIG. 2 is an expanded vertical sectional view of the FIG. 1 dispensing closure comprising a spout cap and a spout cover.
FIG. 3 is a side elevational view of the spout cover of FIG. 2, shown partly broken away.
FIG. 4 is a side elevational view, partly broken away, of the spout cover and cap of FIG. 2 assembled together with the cover in a discharge orifice closed position.
FIG. 5 is a view similar to FIG. 4 with the cover shown in a discharge orifice open position.
FIG. 6 is a vertical sectional view taken substantially along the line 6—6 of FIG. 4.

Turning now to the drawings wherein like reference characters refer to like and corresponding parts throughout the several views, the dispensing closure generally designated 10 in FIG. 1 is shown mounted on a plastic squeeze container 11 having a deformable wall or at least one deformable wall portion.

The closure comprises a cap 12 internally threaded as 13 (FIG. 2) for threaded engagement with the external threads on neck 14 of the container. Otherwise, the cap may be snap fitted in place over the container neck opening.

The cap has a transverse end wall 15 containing a discharge opening 16 in communication with the interior of the container. Wall 15 supports a longitudinally extending discharge spout 17 communicating with opening 16, coaxial with the cap, and having an end 18 remote from discharge opening 16 which end contains a product discharge orifice 19. And, the cap has an upstanding peripheral wall 21 extending from wall 15. As shown in FIG. 6, wall 21 has a pair of opposed internal spherical or the like depressions 22 defining bearing cups for purposes as will be described in more detail hereinafter.

The dispensing closure further comprises a spout cover generally designated 23 in FIGS. 2 and 3 hingedly connected to the cap. The spout cover has a transverse base wall 24 with a depending peripheral wall 25 having a pair of opposed, outwardly extending and spherically shaped trunnions 26 respectively seated in bearing cups 22 for hingedly connecting the spout cover to the cap.

Base 24 of the spout cover supports a longitudinally extending arm 27 which may be contoured to snugly embrace the spout in the discharge closed position of FIG. 4. A lid 28 is mounted on the distal end of arm 27 and extends in a transverse direction for overlying discharge orifice 19 in the discharge closed position of FIG. 4.

The underside of the lid has a spherically shaped protrusion 29 sized for snap fitting engagement with orifice 19 and for sealing the discharge orifice closed in the FIG. 4 position.

As shown in FIG. 4, wall 25 depending from base 24 of the spout cover is spaced from end wall 15 of the cap. And, upstanding wall 21 of the cap has a cutout 31 at one side of the transverse axis 32 about which the spout cover is rocked between discharge closed and open positions. Cutout 31 avoids interference by wall 21 upon manual depression of one side 33 of base 24 of the spout cover.

In operation, lid 28 of the spout cover overlies the spout orifice in the discharge closed position of FIG. 4 and is snap locked in place as dimple 24 engages the orifice. In this position, the spout orifice is sealed closed. To uncover the spout, the operator simply depresses side 33 of base 24 at one side of axis 32 thereby causing the spout cover to rock about hinge axis 32 to the discharge open position shown in FIG. 5. Protrusion 29 is sufficiently shallow to permit rocking movement without much interference. And, the lower edge of depending wall 25 may be designed to bottom out by contacting the upper surface of transverse wall 15 to limit the extent of open rocking movement of the spout cover shown in FIG. 5.

The container is now ready for use by simply squeezing the container wall as in any normal squeeze container operation.

To reclose the spout, the operator simply depresses opposite side 34 of base 24 of the spout cover causing the spout cover to rock about transverse axis 32 into the discharge closed position of FIG. 4 as dimple 29 snap fits into engagement with the spout orifice as it partially extends thereinto. Otherwise, the operator may apply a force against arm 27 in a direction toward the spout to effect spout closing from the FIG. 5 to the FIG. 4 position. Oftentimes, pasty or viscous product issuing from the spout orifice after the dispensing operation tends to build up at the orifice and clog if left open to dry. Lid 28 with its dimple prevents clogging due to drying by sealing the spout orifice closed. And, lid 28 produces somewhat of a shearing action in wiping the orifice clean each time the spout is closed.

From the aforegoing it can be seen that a simple and reliable yet highly effective toggle action dispensing closure has been devised in which the transverse hinge axis substantially intersects the central axis of the discharge spout and cap thereby requiring a minimum of space to permit rocking movement of the spout cover between the discharge closed and open positions. The spout base at one side of axis 32 is simply depressed for opening the spout thereby avoiding the need for any bulky and any unsightly finger grip or the like on lid 28, arm 27 or on any other portion of the spout cover to facilitate uncovering the spout. And, the spout is nested within arm 27 of the spout cover rendering the assembly streamlined and avoiding any external projections which would interfere with an overcap or packaging of the product.

After the dispensing operation, the spout base is depressed at the opposite side of axis 32 for reclosing and sealing the spout orifice and for snap locking lid 28 in place.

Obviously, many modifications and variations of the present invention are made possible in the light of the above teachings. For example, the underside of lid 28 could instead be provided with a groove for the reception of a bead at the upper end of the spout about the orifice to effect snap fit engagement, without departing from the invention.

It is therefore to be understood that within the scope of the appended claims the invention may be practiced otherwise than as specifically described.

What is claimed is:

1. A dispensing closure for a squeeze container having at least one deformable wall portion, comprising:

a cap for mounting on a neck of a container, the cap having a longitudinal axis and an end wall traverse to said axis and containing a discharge opening, a discharge spout on said end wall, said spout extending longitudinally and being in communication with said opening, an end of said spout remote from said opening containing a discharge orifice;

a spout cover having a base wall transverse to said longitudinal axis for hingedly connecting said cover to said cap for manual rocking movement between discharge orifice closed and open positions about a hinge axis parallel to said end wall, said base wall containing an opening through which said spout extends, a lid supported a spaced distance above said base wall for closing said discharge orifice in said closed position, said hinge axis being spaced from said end wall a shorter distance compared to the spacing of said hinge axis from said spout end; and means acting between said lid and said spout end for snap locking said lid to said spout end and for sealing said lid to said discharge opening in said closed position.

2. The closure according to claim 1, wherein said cap has an upstanding wall surrounding said base wall, said hinge axis extending through said upstanding wall, a portion of said upstanding wall being recessed relative to one side of said base wall to permit manual depression of said one side for rocking said cover into said open position.

3. The closure according to claim 1, wherein said cover has a longitudinally extending arm supporting said lid on said base wall, said arm being contoured to that of said spout and lying along said spout in said closed position.

4. The closure according to claim 1, wherein said snap lock means comprises a protrusion on an underside of said lid engageable with said remote end of said spout in said closed position.

* * * * *